US010251434B1

(12) United States Patent
Kumar

(10) Patent No.: US 10,251,434 B1
(45) Date of Patent: Apr. 9, 2019

(54) CONSCIOUS RHYTHMIC BREATHING DEVICE

(71) Applicant: Sai Kumar, Dallas, TX (US)

(72) Inventor: Sai Kumar, Dallas, TX (US)

( * ) Notice: Subject to any disclaimer, the term of this patent is extended or adjusted under 35 U.S.C. 154(b) by 850 days.

(21) Appl. No.: 13/711,528

(22) Filed: Dec. 11, 2012

(51) Int. Cl.
*A61F 5/56* (2006.01)
*A41D 13/05* (2006.01)

(52) U.S. Cl.
CPC ..... *A41D 13/0556* (2013.01)

(58) Field of Classification Search
CPC .. A41D 13/0556; A41D 13/055; A41D 13/05; A61F 5/56; A61F 5/08; A61M 16/00; A61M 16/003; A61M 16/0051; A61M 16/0666; A61M 2230/40; A61M 2230/42; A61M 2230/46; A62B 23/00; A62B 23/06; A61B 5/7405; A61B 5/74; A61B 5/087; A61B 5/09; A63B 23/185; A63B 23/18
USPC ..... 128/858, 857, 848; 600/534, 529
See application file for complete search history.

(56) References Cited

U.S. PATENT DOCUMENTS 4,781,686 A * 11/1988 Erickson ..... A61M 1/3639 137/540
5,203,343 A * 4/1993 Axe et al. ..... 600/538
8,322,340 B2 * 12/2012 Talmon ..... A62B 23/06 128/206.11
2009/0277459 A1 * 11/2009 Al-Zeir ..... A61F 5/08 128/848
2010/0268131 A1 * 10/2010 Efthimiou ..... A62B 7/10 601/47
2014/0058733 A1 * 2/2014 Voorhees ..... G09B 21/005 704/260

* cited by examiner

*Primary Examiner* — Victoria J Hicks
(74) *Attorney, Agent, or Firm* — MP Patents, LLC

(57) ABSTRACT

A device to increase a person's awareness of his or her breathing rhythm is disclosed. The device includes a clip, an air deflection plate, and a hinge connecting the air deflection plate to the clip. The air deflection plate may rotate about the hinge, relative to the clip. The air deflection plate may at least partially occlude a user's nostril when the clip is attached to the user's nose.

7 Claims, 4 Drawing Sheets

CONSCIOUS RHYTHMIC BREATHING DEVICE

CROSS-REFERENCE TO RELATED APPLICATIONS

This application claims priority under 35 U.S.C. § 119(e) to provisional U.S. Patent Application No. 61/636,638, filed on Apr. 21, 2012, the disclosure of which is expressly incorporated by reference herein in its entirety.

BACKGROUND OF THE PRESENT DISCLOSURE

1. Field of the Present Disclosure

The present disclosure is directed to a device that assists a user with breathing consciously, slowly, and rhythmically. The device may enable a user to transform unconscious breathing into a conscious activity.

2. Related Art

Yoga has become a commonplace activity because it provides relaxation, stress reduction, and promotion of overall health. Yoga practices cause a participant to become more aware of his body and conscious of the present moment. This body-awareness and presence are key to the benefits of yoga. While the benefits of yoga continue once a class or session is completed, they may wear off or dissipate over time due to busy schedules, modern lifestyles and constant stress. Accordingly, there is a need for "yoga on the go."

SUMMARY OF THE PRESENT DISCLOSURE

The present disclosure assists an individual with being mindful of his breathing, which may help him to be more aware of his body and the present moment. This awareness may promote relaxation and/or reduce stress, as well as other advantages apparent from the discussion herein.

According to one aspect of the present disclosure, a device may increase a person's awareness of his or her breathing. The device may include a clip configured to attach to the user's nose, and a hinge connected to the clip. The device may also include an air deflection plate rotatably connected to the hinge. The air deflection plate is configured to rotate relative to the clip. The air deflection plate is also configured to at least partially occlude a nostril of the user when the clip is attached to the user's nose.

Additional features, advantages, and aspects of the present disclosure may be set forth or apparent from consideration of the following detailed description, drawings, and claims. Moreover, it is to be understood that both the foregoing summary of the present disclosure and the following detailed description are exemplary and intended to provide further explanation without limiting the scope of the present disclosure as claimed.

BRIEF DESCRIPTION OF THE DRAWINGS

The accompanying drawings, which are included to provide a further understanding of the present disclosure, are incorporated in and constitute a part of this specification, illustrate aspects of the present disclosure and together with the detailed description serve to explain the principles of the present disclosure. No attempt is made to show structural details of the present disclosure in more detail than may be necessary for a fundamental understanding of the present disclosure and the various ways in which it may be practiced. In the drawings.

DETAILED DESCRIPTION OF THE PRESENT DISCLOSURE

Figure 1:
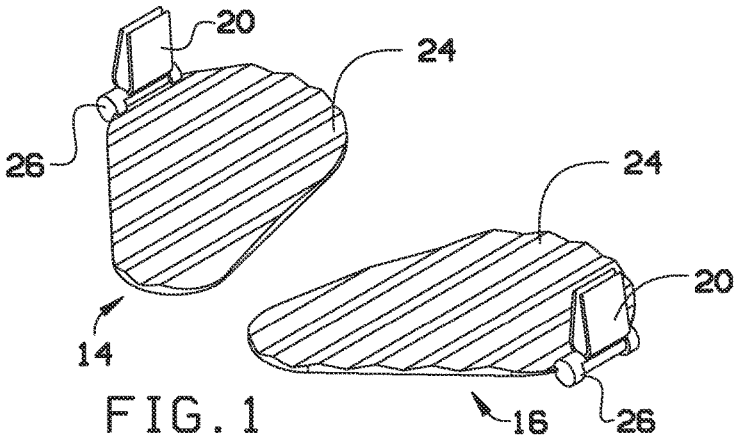
FIG. 1 shows an exemplary conscious rhythmic breathing device, according to an aspect of the present disclosure.

The aspects of the present disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the present disclosure. The examples used herein are intended merely to facilitate an understanding of ways in which the present disclosure may be practiced and to further enable those of skill in the art to practice the aspects of the present disclosure. Accordingly, the examples and aspects herein should not be construed as limiting the scope of the present disclosure, which is defined solely by the appended claims and applicable law. Moreover, it is noted that like reference numerals represent similar parts throughout the drawings.

Breathing exercises, such as, e.g., pranayama, are commonly used in many religious, spiritual, and meditation practices to focus an individual's mind on his body and the present moment. By focusing on his body and the present, the individual's mind may release or let go of stress, worries, anxiety, anger, and other emotions. Individuals with busy lives and hectic schedules may forget or simply not think to put these types of practices to use in their everyday lives, such as when, e.g., using a computer, driving a car, waiting in line, and so on. Accordingly, there is a need for "yoga on the go."

Figure 2:
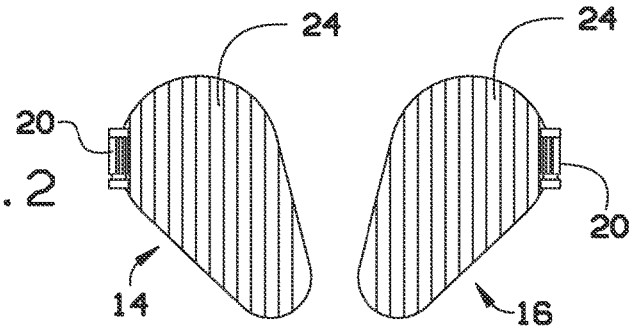
FIG. 2 shows a top view of the exemplary device of FIG. 1.

FIG. 1 shows an exemplary conscious rhythmic breathing device, according to an aspect of the present disclosure, and FIG. 2 shows a top view of the exemplary device of FIG. 1. The device may help the user to be aware of his breathing pattern and to engage in conscious and rhythmic breathing. This type of breathing, which may be slow and rhythmic, may be similar to breathing that takes place during yoga or other relaxation practices. By practicing this type of breathing more frequently in his daily life, the user of the device may, for example, focus more on the present moment, reduce stress, increase relaxation, and so on.

An exemplary conscious rhythmic breathing device may include a single device or a pair of devices, as shown, e.g., in FIG. 1. A pair may include a right nostril device 14 and a left nostril device 16. An individual conscious rhythmic breathing device may include an air deflection plate 24 connected to a hinge 26. The air deflection plate 24 may include one or more holes or perforations (not shown) or may include no holes or perforations so as to be solid as illustrated in FIGS. 1, 2, 7 and 8. Perforations may be any shape, such as, e.g., circular, square, or rectangular. Aspects of the present disclosure may include an air deflection plate 24 that has most or all of its surface covered with perforations. Such an air deflection plate 24 may be regarded as an air deflection net or an air deflection mesh. A clip 20 may also be connected to the hinge. The clip 20 may be fixed relative to the hinge 26, while the air deflection plate 24 may rotate about the hinge relative to the clip 20 as well as relative to a user's nostril. The air deflection plate 24 may have an irregular or corrugated upper surface, an irregular or corrugated lower surface, or both. For example, deflection plates may include an irregular or corrugated inner surface and a flat outer surface opposite the inner surface as illustrated in FIGS. 3-6, 9 and 10. The irregular or corrugated surface may be formed only from parallel ridges extending in a single direction and may assist with making a user more aware of his breathing, as discussed below. The parallel ridges may be spaced apart in a direction substantially perpendicular to the direction the parallel ridges extend as shown in FIGS. 1-10.

Figure 3:
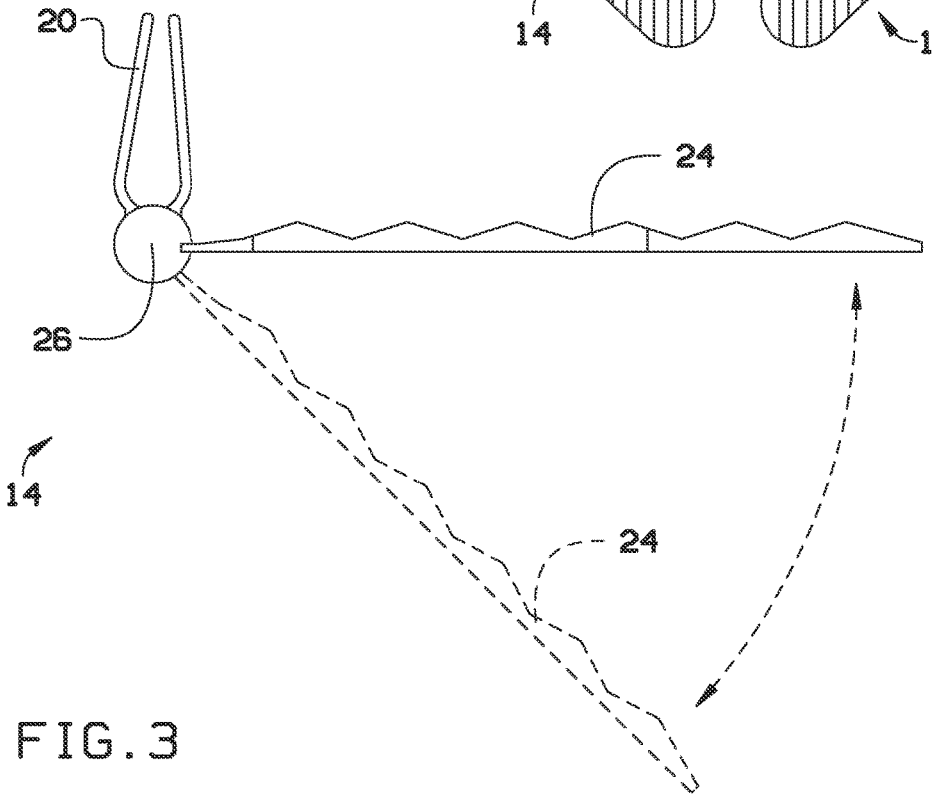
FIG. 3 shows a rotational motion of the exemplary device of FIG. 1.
Figure 4:
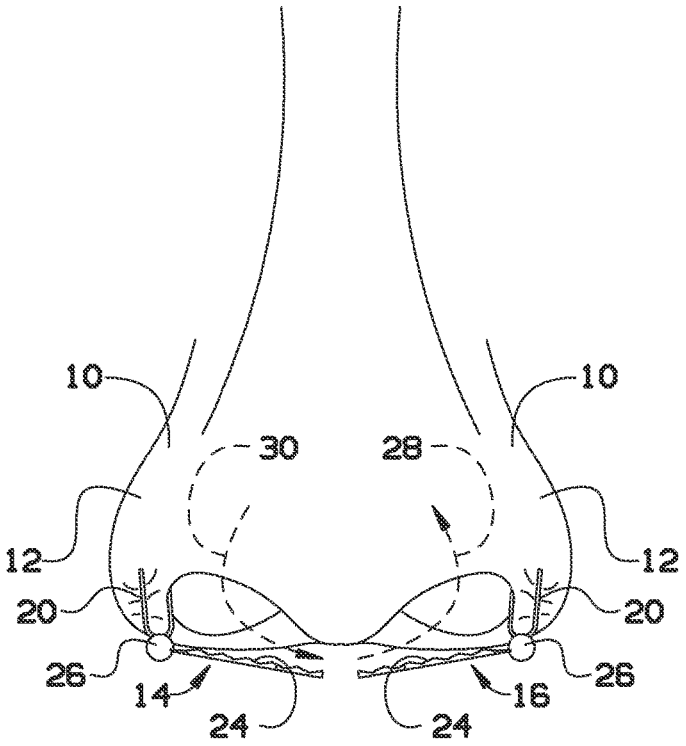
FIGS. 4, 5, and 6 show the exemplary device of FIG. 1 in relation to a user's nose.
Figure 5:
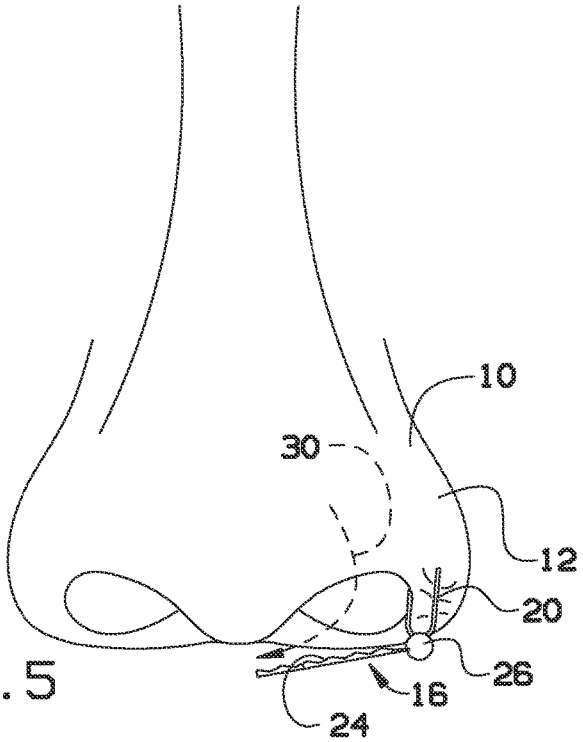
Figure 6:
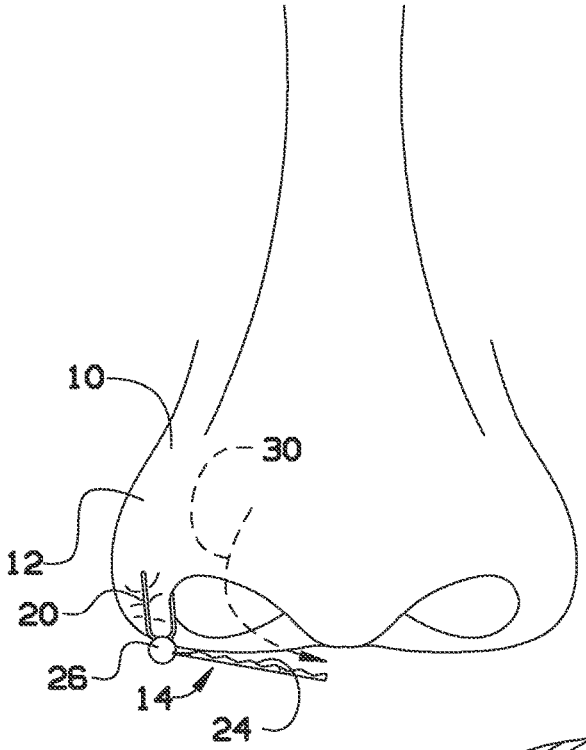

FIG. 3 shows a rotational motion of the exemplary device of FIG. 1, and FIGS. 4-6 show the exemplary device of FIG. 1 in relation to the nose 12 of a user 10. The clip 20 may be used to removably attach the device to the user's nose 12, for example, at the nostril. The device may be oriented so that the air deflection plate 24 at least partially covers or occludes a nostril. The deflection plate 24 may rotate relative to the hinge 26 to deflect airflow from the nostril through a smaller opening. Deflecting the airflow may make the user more aware of his breathing and/or remind the user to practice conscious breathing techniques. Due to the smaller opening, airflow through the nostril may be reduced. As a result, breathing may become more deliberate, but not so much that the user must breathe through his mouth. This increased effort or difficulty may make the user more aware of his breathing and/or remind the user to practice conscious breathing techniques.

The air deflection plate 24 may be configured to produce a sound, such as, for example, a gentle rustling or swishing sound, in response to the user exhaling, inhaling, or both. Exhalation is illustrated generally by arrow 30, and inhalation is illustrated generally by arrow 28. Production of the sound may be enhanced by the irregular or corrugated surface on the air deflection plate 24. Sound production may also be enhanced by one or more perforations in the air deflection plate 24. The sound may serve to make the user more aware of his breathing and/or remind to practice conscious breathing techniques.

It is estimated that 85% of people breathe out of only one nostril at a time. Switching breathing from one nostril to the other may happen in a cyclical fashion, with a switch typically taking place every four hours or so. This time can vary between individuals and can be affected by factors such as, e.g., body position, nasal congestion, allergies, and so on. As a result, a user of a conscious rhythmic breathing device may only need to use one device to cover one nostril at a time, as shown, e.g., in FIGS. 5 and 6. The unused nostril may be left uncovered.

Figure 7:
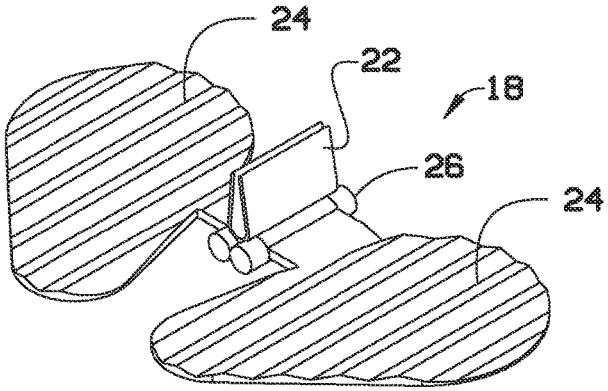
FIG. 7 shows an exemplary conscious rhythmic breathing device, according to an alternate aspect of the present disclosure.
Figure 8:
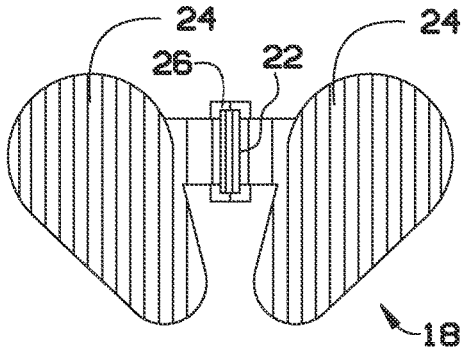
FIG. 8 shows a top view of the exemplary device of FIG. 7.

FIG. 7 shows an exemplary conscious rhythmic breathing device 18, according to an alternate aspect of the present disclosure, and FIG. 8 shows a top view of the exemplary device 18 of FIG. 7. A conscious rhythmic breathing device 18 may include two air deflection plates 24. Each air deflection plate 24 may be connected to a hinge 26. The hinges 26 may be connected to a clip 22.

Figure 9:
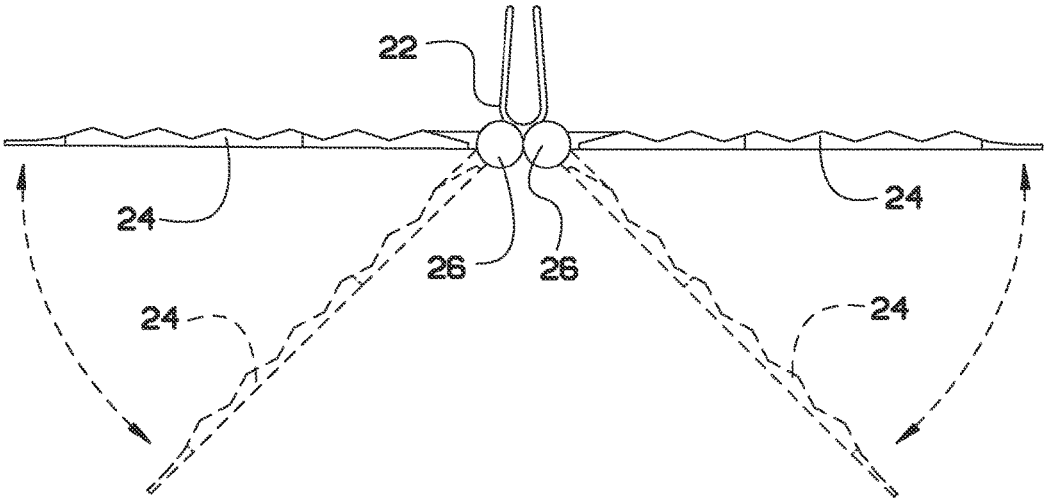
FIG. 9 shows a rotational motion of the exemplary device of FIG. 7.
Figure 10:
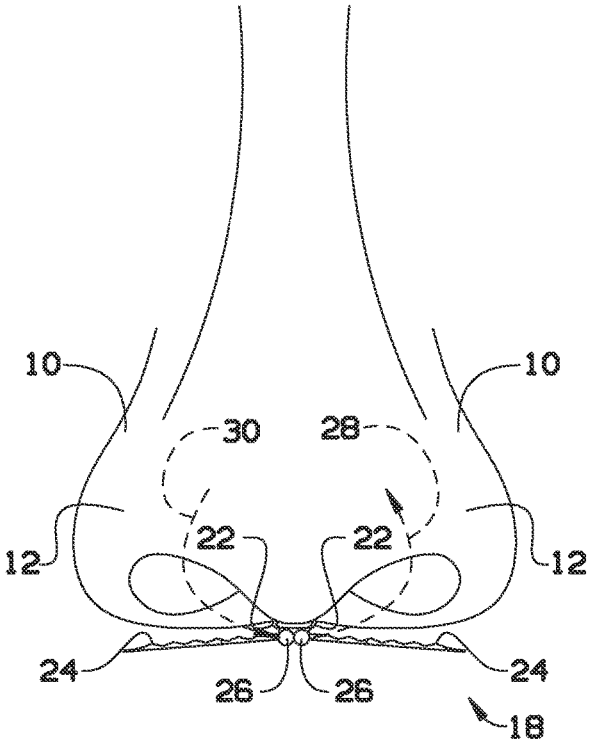
FIG. 10 shows the exemplary device of FIG. 7 in relation to a user's nose.

FIG. 9 shows a rotational motion of the exemplary device of FIG. 7, and FIG. 10 shows the exemplary device of FIG. 7 in relation to a user's nose. The air deflection plates 24 may independently rotate relative to the clip 22. In use, the clip may removably attach to a user's septum between her nostrils 12.

While the present disclosure has been described in terms of exemplary aspects, those skilled in the art will recognize that the present disclosure can be practiced with modifications in the spirit and scope of the appended claims. These examples given above are merely illustrative and are not meant to be an exhaustive list of all possible designs, aspects, applications or modifications of the present disclosure.

What is claimed is:

1. A device for increasing a user's awareness of his or her breathing, the device comprising:

a clip configured to attach to a user nostril;

a first hinge connected to the clip; and a first air deflection plate connected to the first hinge and configured to, when the clip is attached to the user nostril, rotate relative to the user nostril, at least partially occlude the user nostril and produce a sound in response to the user exhaling; the first air deflection plate comprising a corrugated inner surface and a flat outer surface opposite the corrugated inner surface; the corrugated inner surface extending in a first plane, and the flat outer surface extending in a second plane; and wherein the first and second planes are parallel to one another.

2. The device of claim 1, further comprising:

a second hinge connected to the clip; and a second air deflection plate rotatably connected to the second hinge, the second air deflection plate configured to rotate relative to the clip, the second air deflection plate further configured to at least partially occlude a second nostril.

3. The device of claim 1, wherein the sound produced by the first air deflection plate comprises a swishing sound.

4. The device of claim 1, wherein the sound produced by the first air deflection plate comprises a gentle rustling sound.

5. The device of claim 1, wherein the first air deflection plate includes no holes or perforations.

6. A device for increasing a user's awareness of his or her breathing, the device comprising:

a clip configured to attach to the user's nose;

a hinge connected to the clip; and an air deflection plate attached to the hinge and comprising a corrugated inner surface and a flat outer surface opposite the corrugated inner surface, the air deflection plate configured to rotate relative to the clip and to at least partially occlude a first nostril when the clip is attached to the user's nose; the corrugated inner surface extending in a first plane, and the flat outer surface extending in a second plane; and wherein the first and second planes are parallel to one another.

7. The device as set forth in claim 6, wherein the air deflection plate is further configured to produce a sound in response to the user exhaling.

* * * * *